US012320350B2

(12) United States Patent
Menghini

(10) Patent No.: US 12,320,350 B2
(45) Date of Patent: Jun. 3, 2025

(54) INDUSTRIAL PNEUMATIC PUMP FOR A VISCOUS FLUID

(71) Applicant: MECLUBE S.R.L., Gonzaga (IT)

(72) Inventor: Gianni Menghini, Moglia (IT)

(73) Assignee: MECLUBE S.R.L., Gonzaga (IT)

( * ) Notice: Subject to any disclaimer, the term of this patent is extended or adjusted under 35 U.S.C. 154(b) by 175 days.

(21) Appl. No.: 18/256,140

(22) PCT Filed: Dec. 15, 2021

(86) PCT No.: PCT/IT2021/050412
§ 371 (c)(1),
(2) Date: Jun. 6, 2023

(87) PCT Pub. No.: WO2022/137269
PCT Pub. Date: Jun. 30, 2022

(65) Prior Publication Data

US 2024/0035459 A1 Feb. 1, 2024

(30) Foreign Application Priority Data

Dec. 21, 2020 (IT) ..... 102020000031589

(51) Int. Cl.
*F04B 9/137* (2006.01)
*F04B 15/02* (2006.01)

(52) U.S. Cl.
CPC ..... *F04B 9/1372* (2013.01); *F04B 15/02* (2013.01)

(58) Field of Classification Search
CPC ..... F04B 9/1372; F04B 15/02
(Continued)

(56) References Cited

U.S. PATENT DOCUMENTS 3,776,665 A * 12/1973 Dalton ..... F04B 49/007 417/252
5,324,175 A 6/1994 Sorensen et al.
(Continued)

FOREIGN PATENT DOCUMENTS

IT MI20011290 A1 * 12/2002
JP H03281987 A 12/1991
(Continued)

OTHER PUBLICATIONS

English Translation of JP2543426B2 obtained Jan. 16, 2025 (Year: 1996).*
(Continued)

*Primary Examiner* — Connor J Tremarche
(74) *Attorney, Agent, or Firm* — NIXON & VANDERHYE

(57) ABSTRACT

An industrial pneumatic pump for a viscous fluid includes a pump body, a pneumatic cylinder, a piston separating first and second chambers, a pump shaft integral with the piston and sliding in a channel, a pressure chamber with inlet and outlet ports for compressed air, and suction and outlet mouths for the viscous fluid. The pump also includes: a connection chamber connected to the chambers, and to the channel; a distributor including a spool connecting the chambers to an air discharge hole and the air outlet port; opposed first and a second pistons acting on the spool, sliding in a first and a second service chamber connected to the channel by ports, the spool including a thickening cooperating with the outlet port to cause a pressure perturbation in the service chambers causing the immediate displacement of the piston to act on the spool.

11 Claims, 5 Drawing Sheets

(58) Field of Classification Search
USPC ..... 417/339
See application file for complete search history.

(56) References Cited

U.S. PATENT DOCUMENTS

| | | | | |
|---|---|---|---|---|
| 5,415,531 | A | 5/1995 | Cavanaugh | |
| 5,520,520 | A | 5/1996 | Nakamoto et al. | |
| 7,587,897 | B2 * | 9/2009 | Strong | F04B 9/12 91/275 |
| 2017/0335840 | A1 * | 11/2017 | Hausle | F04B 15/02 |

FOREIGN PATENT DOCUMENTS

| | | | |
|---|---|---|---|
| JP | 2543426 | B2 * | 10/1996 |
| WO | 2008124217 | A1 | 10/2008 |
| WO | 2012149013 | A2 | 11/2012 |

OTHER PUBLICATIONS

English Translation of ITMI20011290A1 obtained Jan. 16, 2025 (Year: 2002).*
International Search Report and Written Opinion of the ISA for PCT/IT2021/050412 mailed Feb. 11, 2022, 13 pages.

* cited by examiner

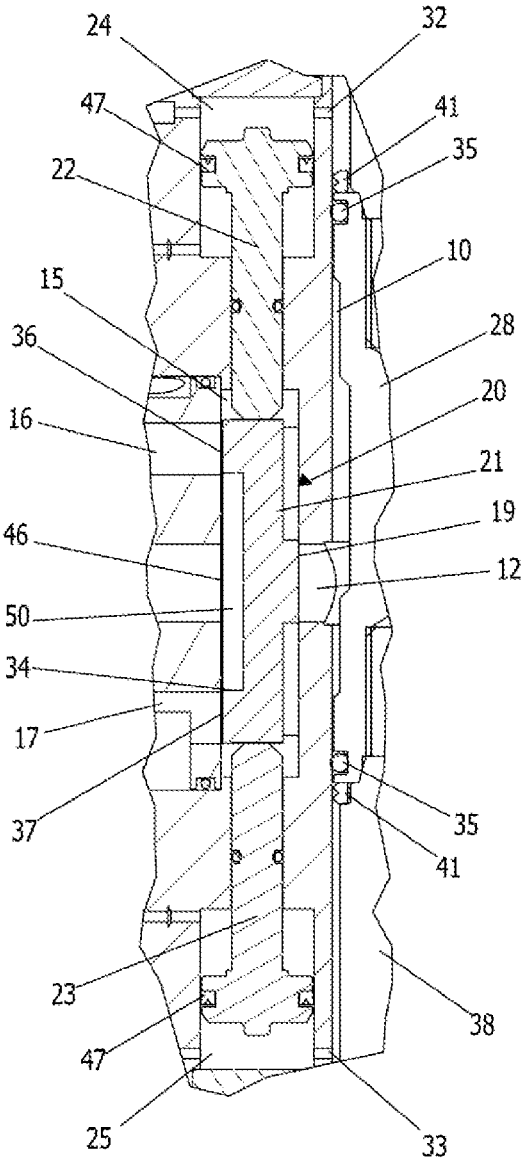
Fig. 2
Fig. 3
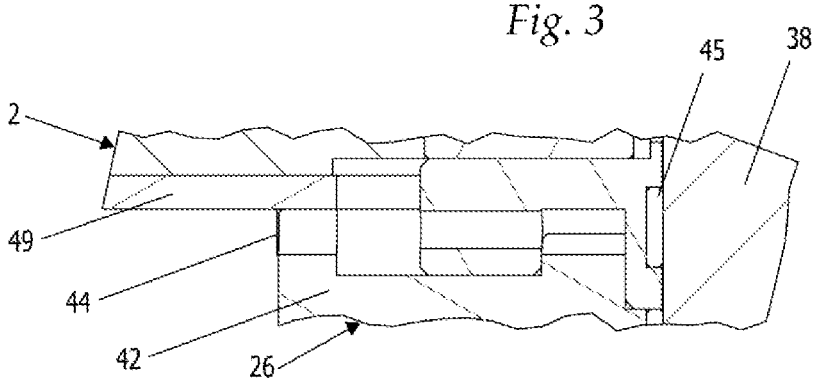

INDUSTRIAL PNEUMATIC PUMP FOR A VISCOUS FLUID

This application is the U.S. national phase of International Application No. PCT/IT2021/050412 filed Dec. 15, 2021 which designated the U.S. and claims priority to IT 102020000031589 filed Dec. 21, 2020, the entire contents of each of which are hereby incorporated by reference.

TECHNICAL FIELD OF APPLICATION

The present invention relates to the field of industrial pumps and in particular it relates to an industrial pneumatic pump for viscous fluids, for example suitable for the transfer and distribution of grease and oil.

BACKGROUND ART

Pumping systems with pneumatic actuation for greasing and lubrication are known.

Said systems, commonly referred to as pneumatic pumps for grease and oil, essentially consist of a double-acting pneumatic cylinder comprising a liner, a piston, an upper chamber and a lower chamber separated by said piston.

Said pneumatic pumps then comprise means for reversing the motion of said piston adapted to put the two opposite chambers of the pneumatic cylinder in communication respectively and alternatively with a pneumatic air supply device and with the discharge into the atmosphere.

The rod of said piston constitutes the pump shaft which, when moved alternately, carries out the suction and expulsion of the viscous fluid, oil or grease.

The means for reversing the motion of the piston are usually subject to the action of mechanical parts, for example steel springs and balls, which do not always guarantee effective operation without jams, with consequent need for frequent stops of the system to carry out maintenance, in addition to premature wear of the pump.

These mechanical parts do not even guarantee a constant pressure in the cylinder chambers for the entire stroke of the piston.

From the Italian patent n. 01305786 by the same applicant, a pneumatic pump without mechanical members for activating the means for reversing the motion of the piston is known, these in fact are subject only to the pneumatic action of the air and there are no longer any springs or other mechanical members.

In detail, said pneumatic pump includes:

- a pump body;
- a double-acting pneumatic cylinder comprising an external liner, a piston, a first chamber and a second chamber separated by said piston;
- a pump shaft integral with said piston and sliding in a channel;
- a pressure chamber arranged along said channel and provided with an inlet port for compressed air and an outlet port for said air;
- a suction mouth for said viscous fluid;
- an outlet mouth for said viscous fluid;
- a connection chamber connected to said first and second chambers by means of a first and a second duct, respectively, and to said channel in which said pump shaft slides by means of said outlet port, and provided with a hole for discharging air into the atmosphere;
- a distributor comprising a spool adapted to put said first chamber and said second chamber in communication respectively and alternatively with said inlet port and with said an outlet port of said air, implementing a motion reversal system for said double-acting pneumatic cylinder;
- a first and a second pneumatic pistons acting opposite each other on said distributor to move it in said connection chamber, sliding respectively in a first and a second service chamber connected to said channel in which said pump shaft slides;
- a base for fixing said pump body to a dip tube in which said suction mouth is formed.

Said distributor sliding in said connection chamber due to the effect of said pneumatic pistons opens or closes said first and second duct alternatively, putting the respective chambers of said pneumatic cylinder under pressure or discharging them.

However, said pneumatic pump still has limitations and drawbacks.

A serious drawback of this type of pneumatic pump is the need to allocate a part of the stroke and internal pressures of the pump to move the complex exchange mechanisms, distributor and pneumatic pistons: consequently, the piston slows down its stroke, drastically dropping the oil pressure, negatively affecting its constant supply, also leading to stalling of the system for which the pump is intended.

Furthermore, in the transition from a classic pneumatic pump with small dimensions (for example piston with diameter 60 mm and 45 mm stroke) to an industrial pneumatic pump with larger dimensions (for example piston with 115 mm diameter and 82 mm stroke), the oil pumping flow rates can no longer be guaranteed by the working pressures of the pneumatic cylinder, partly dispersed in the movement of the pistons and of the distributor.

Further drawbacks are then linked to the construction of the pump and the individual components:

- standard and commercial gaskets are not suitable for the specific use for which they are intended;
- the pump body is worked with inaccurate tolerances and with narrow air passage channels and ducts that do not guarantee suitable flow rates for pump operation;
- the base connecting the pump body to the suction tube, made of cast aluminium, does not guarantee perfect alignment of the suction shaft and therefore jeopardizes the operation thereof;
- the brass distributor, machined by machine tool, does not guarantee optimal seals as it cannot be ground using a machine tool.

DISCLOSURE OF THE INVENTION

The main object of the invention is therefore to implement a pneumatic industrial pump for grease and oil which has a high efficiency, uniformity, precision and operating safety, without jamming even in the most severe operating conditions, and for applications that require large volumes of substance pumped.

The objects are achieved with an industrial pneumatic pump for a viscous fluid comprising:

- a pump body;
- a double-acting pneumatic cylinder comprising an external liner, a piston, a first chamber and a second chamber separated by said piston;
- a pump shaft integral with said piston and sliding in a channel;
- a pressure chamber arranged along said channel and provided with an inlet port for compressed air and an outlet port for said air;
- a suction mouth for said viscous fluid;

an outlet mouth for said viscous fluid;

a connection chamber connected to said first and second chambers by means of a first and a second duct and corresponding access holes, respectively, and to said channel in which said pump shaft slides by means of said outlet port, and provided with a hole for discharging air into the atmosphere;

a distributor comprising a spool adapted to put said first chamber and said second chamber in communication respectively and alternatively with said air discharge hole to the atmosphere and with said an outlet port of said air, implementing a reversal system for said double-acting pneumatic cylinder;

a first and a second pneumatic pistons acting opposite each other on said spool to move it in said connection chamber, sliding respectively in a first and a second service chamber connected to said channel in which said pump shaft slides by means of ports;

a base for fixing said pump body to a dip tube in which said suction mouth is formed, wherein said spool sliding in said connection chamber due to the effect of said pneumatic pistons opens or closes the access holes to said first and second duct alternatively, putting the respective chambers of said pneumatic cylinder under pressure or discharging them, characterized in that said spool comprises a thickening adapted to cooperate with said air outlet port from said pressure chamber to modulate the entry of air into said connection chamber and cause a pressure perturbation in the service chambers of said first and second pneumatic piston, causing the immediate displacement of the piston called to act on the spool.

According to a first aspect of the invention, said spool has an elliptical disc shape and comprises a first face facing said air outlet port from said pressure chamber and a second face facing said discharge hole into the atmosphere.

Advantageously, said thickening is obtained in a central portion of said first face of said spool.

Furthermore, said second face of said spool comprises a raised edge, where said raised edge cooperates alternatively with access holes to said first and second ducts.

In a preferred variant of the invention, said pump shaft comprises a first, a second and a third elongated element, each having a first and a second end, where:

the first end of said first elongated element is stably associated with said piston;

the second end of said first elongated element is stably associated with the first end of said second elongated element with the interposition of a first ring gasket;

the second end of said second elongated element is stably associated with the first end of said third elongated element with the interposition of a second ring gasket;

the second end of said third elongated element is associated with said dip tube by means of a non-return valve.

Advantageously, said first and said second ring gaskets define said pressure chamber inside said channel.

Preferably, said first and second ring gaskets are supported along said pump shaft by centring bushings comprising a mixture of acetal resin and glass fibre.

According to further aspects of the invention:

said third elongated element of said pump shaft is selected from a plurality of elements with different diameters according to the type and flow rates of viscous fluid pumped and the type of dip tube;

said base comprises a hollow cylindrical body reversibly fixed to said pump body by means of screws.

In a preferred variant of the invention, said base comprises a radial outlet sight hole for conveying outwards any oil leaks from said dip tube and thus signalling leaks.

Advantageously, said first and second connecting ducts between said connection chamber and said first and second chambers separated by said piston are entirely contained within said pump body.

The industrial pump according to the invention is suitable for the high pressure transfer of high viscosity greases and fluids and of lubricating and similar oils over short and long distances.

The invention has numerous advantages.

The operation of the double-acting pneumatic cylinder in conjunction with the improved system of reversing the motion of the pneumatic piston, guarantees a delivery of the viscous fluid with a continuous and constant flow, and maximizes performance in installations and systems that require dispensing of large volumes of pumped product.

The piston motion inversion system, without springs and mechanical parts, increases pump reliability and reduces working noise with greater fluid delivery.

The shape and geometry of the distributor spool creates a back pressure phenomenon inside the pump; the thickening of the spool allows choking the air outlet port from the pressure chamber to the connection chamber during the inversion step of the piston motion, accelerating the response of the pneumatic pistons and minimizing the downtime of the pump.

A further advantage consists in keeping the piston chamber in use under pressure until the exchange is completely completed, which allows the pump to suck and push the viscous fluid pumped at maximum power even in the last millimetres of the pump shaft stroke, making the flow perfectly constant with no slowdowns detected.

In detail, by modulating the passage of air in the connection chamber, a counter pressure is generated inside the service chambers of the individual pneumatic pistons which amplifies their response and their action on the distributor spool, reducing the inversion time of the pump to a minimum and allowing constant delivery of the viscous fluid, without appreciable drops and with high silence, eliminating the risk of pneumatic stall, and making the pump particularly suitable for installation in centralized distribution systems provided with multiple delivery points, with working pressures which may vary from a maximum of 8 bar to a minimum of 3 bar.

The pump shaft divided into several elements, of which the third in contact with the suction tube is interchangeable, like the base which may be reversibly associated with the pump body, make the pneumatic pump modular, easily adaptable to various needs, depending on the type of viscous fluid, on its degree of viscosity and on the required flow rates.

The base then improves the centring of the pump shaft along its sliding channel, while its external cylindrical shape makes its assembly on the pump body and maintenance operations practical.

Furthermore, with respect to the prior art:

the air passages inside the entire pump are not bound to the shape of a device that must include cams and springs in its design, it follows the possibility of designing the internal channels and ducts of the pump without constraints, in order to obtain the maximum thrust capacity of the pneumatic piston;

the lack of internal mechanical parts definitively eliminates the common problems of wear and mechanical blocking of the devices for reversing the motion of the piston (distributor, spool and pneumatic pistons);

the greater fluid dynamic efficiency resulting from the design innovations of the pump allows the achievement of high operating pressures with minimum wear.

BRIEF DESCRIPTION OF THE DRAWINGS

The advantages of the invention shall appear more clearly from the following description of a preferred embodiment, made by way of an indicative and non-limiting example with reference to the figures, in which:

FIGS. 2 and 3 show a longitudinal section view along a vertical plane of two details of the pneumatic pump of FIG. 1;

DETAILED DESCRIPTION OF A PREFERRED EMBODIMENT OF THE INVENTION

Figure 1:
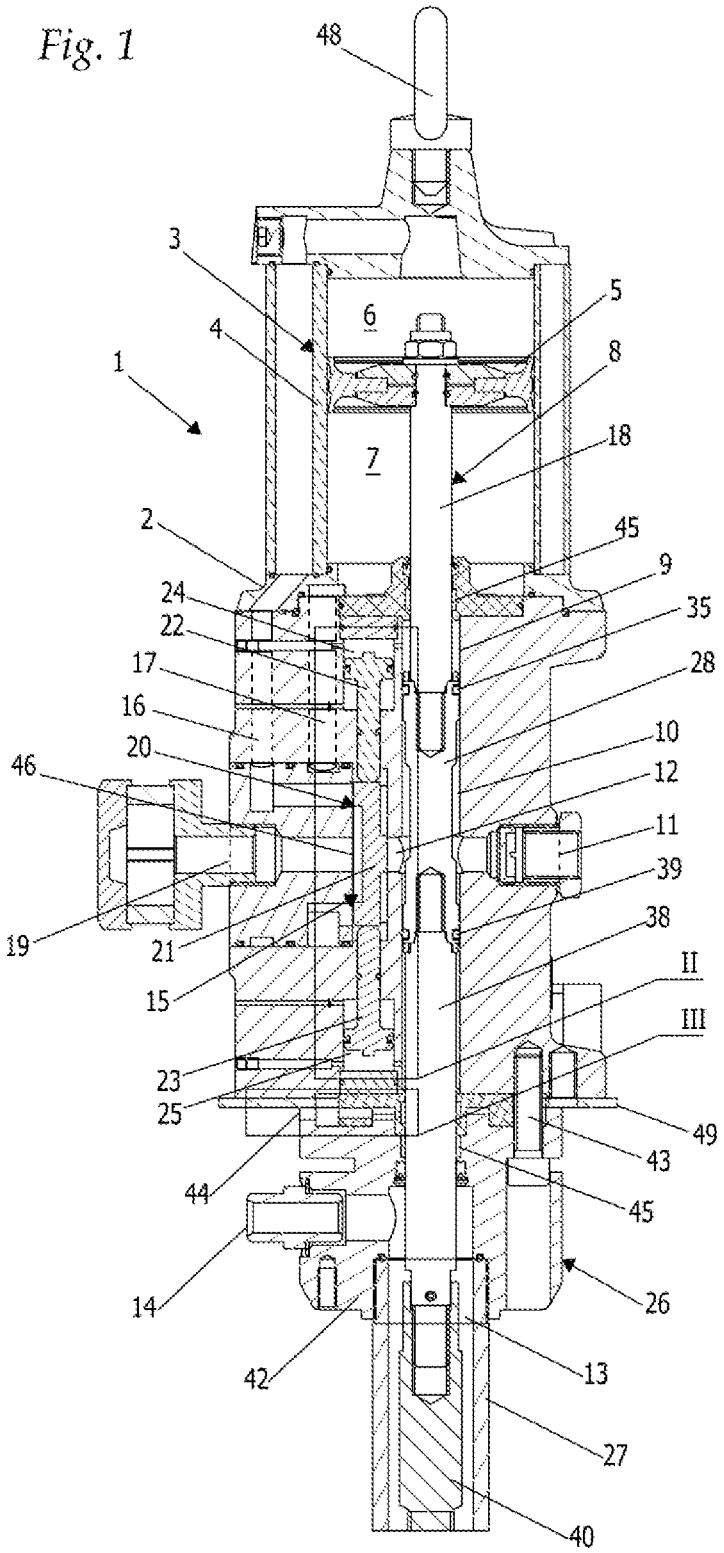
FIG. 1 shows a longitudinal section view along a vertical plane of an industrial pneumatic pump for viscous fluids according to the invention.
Figure 4:
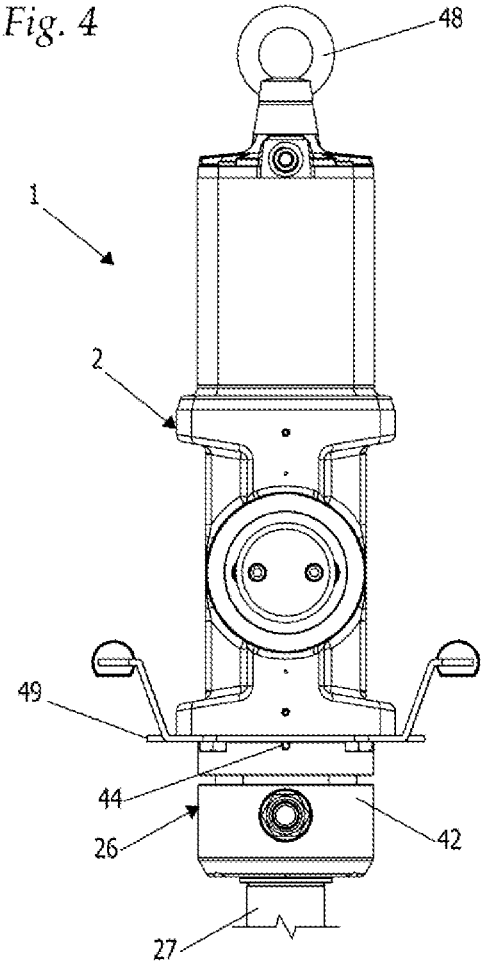
FIGS. 4 and 5 show a front view and a plan view from below, respectively, of the pneumatic pump of FIG. 1.
Figure 8:
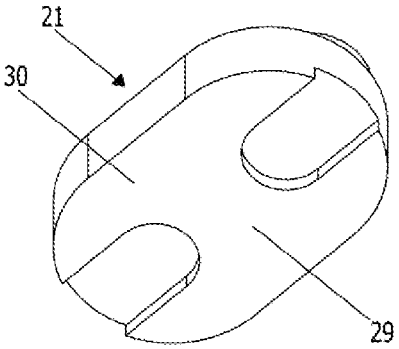
FIGS. 8 and 9 show an axonometric view of a component of the industrial pneumatic pump according to the invention.
Figure 9:
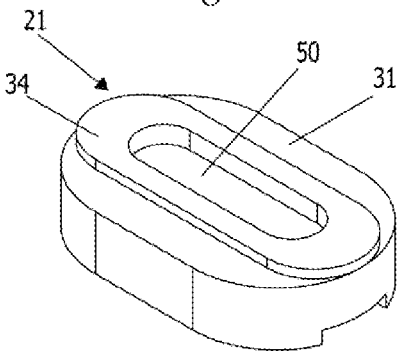
Figure 5:
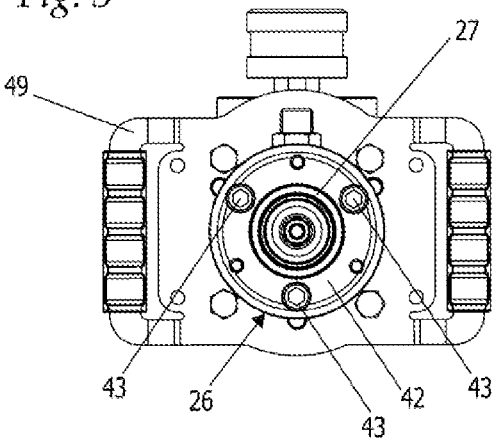

With reference to the Figures, an industrial pneumatic pump 1 for a viscous fluid is shown comprising:

a pump body 2;

a double-acting pneumatic cylinder 3 comprising a liner 4, a piston 5, a first chamber 6 and a second chamber 7 separated by said piston 5;

a pump shaft 8 integral with said piston 5, supported and centred by bearings 45, and sliding in a channel 9 coaxial with said pump body 2;

a pressure chamber 10 arranged along said channel 9 and provided with an inlet port 11 for compressed air and an outlet port 12 for said air;

a connection chamber 15 connected to said first 6 and second 7 chambers by means of a first 16 and a second 17 duct and corresponding access holes 36, 37, respectively, and to said channel 9 in which said pump shaft 8 slides by means of said outlet port 12, and provided with a hole 19 for discharging air into the atmosphere;

means for reversing the motion for said piston 5 of said pneumatic cylinder 3;

a base 26 for fixing said pump body 2 to a dip tube 27 in which a suction mouth 13 for said viscous fluid and an outlet mouth 14 for the pumped fluid are formed.

Said pump shaft 8 comprises a first 18, a second 28 and a third elongated element 38, screwed together.

The external surface of said pump shaft 8 is advantageously subjected to a treatment made of hard nickel-chromium and subsequently ground h7, to guarantee the duration of the shaft and the relative functionality.

Said elongated elements 18, 28, 38 each comprise a first and a second ends, where:

the first end of said first elongated element 18 is stably associated with said piston 5;

the second end of said first elongated element 18 is stably associated with the first end of said second elongated element 28 with the interposition of a first ring gasket 35;

the second end of said second elongated element 28 is stably associated with the first end of said third elongated element 38 with the interposition of a second ring gasket 39;

the second end of said third elongated element 38 is associated with said dip tube 27 by means of a non-return valve 40.

Said second elongated element 28 comprises at its ends grooves suitable for housing said polyurethane ring gaskets 35, 39.

Said gaskets 35, 39, obtained by turning, by virtue of their particular internal section of convex C-shape and the high smoothness given by the polyurethane compound used, reduce ordinary maintenance to a minimum and increase the life of the pump 1 also increasing the response speed of the means for reversing the motion of the piston 5.

Said first 35 and second 39 ring gaskets are supported along said pump shaft 8 by centring bushings 41 comprising a mixture of acetal resin and glass fibre (bearite). Such mixture ensures superior performance to the common bronze traditionally used for bearings and guides, ensuring less power absorption and less friction to the advantage of power delivered and less wear of the sealing elements.

Said first 35 and said second 39 ring gaskets define said pressure chamber 10 inside said channel 9.

Said pressure chamber 10 is always in communication during the entire stroke of the pump shaft 8 with the pneumatic supply of the external air, through said inlet port 11, and with said connection chamber 15, through said outlet port 12.

Said third elongated element 38 of said pump shaft 8, connected below said suction tube 27 with non-return valve 40, during the upward stroke of the piston 5 has the task of suctioning the fluid to be pumped and during the downward stroke of the piston itself has the task of expelling said fluid through said outlet mouth 14.

Said third elongated element 38 of said pump shaft 8 is interchangeable and is selected from a plurality of elements with different diameters according to the type and flow rates of viscous fluid pumped and the type of dip tube.

Said connection chamber 15 includes:

an upper inlet port, i.e. the access hole 36 from which said first duct 16 extends inside the pump body 2 for connection with said first chamber 6 of the pneumatic cylinder 3;

a lower inlet port, i.e. the access hole 37 from which said second duct 17 (visible dashed) extends inside the pump body 2 for connection with said second chamber 7 of the pneumatic cylinder 3;

an intermediate port 46 connected to said discharge hole 19 into the atmosphere.

Said pneumatic pump 1 then comprises a distributor 20 adapted to act as a means of reversing the motion for said piston 5 of said pneumatic cylinder 3.

Said distributor 20 comprises a spool 31 adapted to put said first chamber 6 and said second chamber 7 in communication respectively and alternatively with said discharge hole 19 into the atmosphere 19 and with said outlet port 12 of said air, thus implementing a motion reversal system for said double-acting pneumatic cylinder 3.

The movement of said distributor 20 is obtained pneumatically in an active way by means of two opposite pneumatic pistons 22, 23 which act alternately on the ends of said spool 21 to move it in said connection chamber 15.

Said pistons 22, 23 slide respectively in a first 24 and a second 25 service chamber connected, by means of inlet ports 32, 33, to said channel 9 in which said pump shaft 8 slides.

Said pneumatic pistons 22, 23 comprise a POM-C type acetal resin other than that commonly used for castings (DELRIN 500); they are obtained from machine tools; they are mounted in the respective service chambers 24, 25 with polyurethane gaskets 47 in order to facilitate smoothness and increase their response speed.

Said spool 21, also made of acetal resin, has an elliptical disc shape and slides vertically in said connection chamber 15.

Said spool 21 comprises a first face 30 facing towards said outlet port 12 for the air from said pressure chamber 10, and therefore towards said pump shaft 8, and a second face 31 facing towards the intermediate opening 46 of said connection chamber 15 which defines said discharge hole 19 into the atmosphere.

Said second face 31 of said spool 21 comprises a raised edge 34 which circumscribes an interconnection cavity 50.

Said raised edge 34 cooperates alternatively with the access holes 36, 37 to said first 16 and second 17 connection duct to the chambers 6, 7, while said interconnection chamber 50 cooperates with said discharge hole 19 into the atmosphere.

Said first face 30 of said spool 21 comprises a thickening 29, formed in its central portion.

Said thickening 29 is adapted to cooperate with said air outlet port 12 of said pressure chamber 10 to modulate the entry of air into said connection chamber 15 and cause a pressure perturbation in the service chambers 24, 25 of said first 22 and second 23 pneumatic piston.

Said spool 21 has been designed with very tight tolerances to allow it to move in the connection chamber 15 and work efficiently, ensuring optimal performance.

Said pump body 2, made of cast aluminium, includes within it machining with reduced tolerances to carry out couplings that guarantee seals in all pump working situations, even the most severe ones. Inside the pump body 2, the ducts 16, 17 and the air passage channels and the service chambers 24, 25 of the pistons 22, 23 are sized to facilitate and ensure the greater efficiency of the spool 21 which acts as a means of reversing the motion of the piston 5 and then the pumping selector. Said pump body 2 is devoid of inlets and housings which traditionally had to house springs and spool locking balls, reducing the number of elements inside the pump and thus obtaining a more linear air passage, without harmful dispersions and recirculation.

Said pump body 2 contains all the components inside it, including the ducts 16, 17 connecting the connection chamber 15 to the chambers 6, 7 of the pneumatic cylinder 3: the pump 1 is therefore protected against impacts and damage in all its parts.

Since the pneumatic pump 1 of the industrial type may have considerable dimensions, being able to satisfy requests for high flow rates, an eyebolt 48 is placed on the top of the pump body 2 for its movement from above.

Said base 26 is made in machine tool from aluminium bar, extremely resistant to traction, it comprises a hollow cylindrical body 42 reversibly fixed, with the interposition of a flange 49, to said pump body 2 by means of screws 43.

Said base 26 comprises a radial outlet sight hole 44 to convey outwards any oil leaks from said dip tube 27 and signal leaks.

The operation of the industrial pneumatic pump 1 according to the invention is illustrated below with particular reference to the sections of FIGS. 6 and 7 relating to the two extreme working positions.

Figure 7:
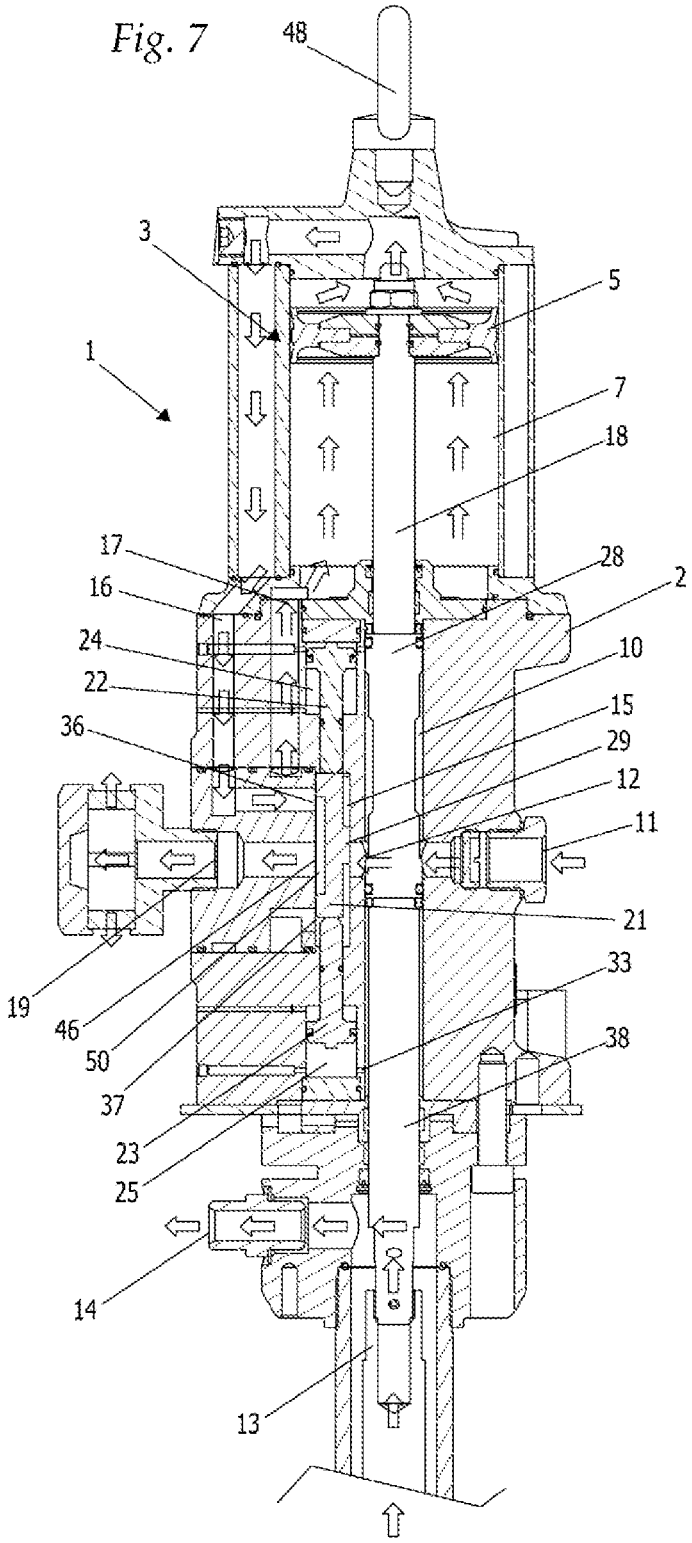

Starting from the conditions highlighted in FIG. 7, the pneumatic pressure feeds, through the inlet port 11, the pressure chamber 10 and, through the port 32, the service chamber 24 of the first pneumatic piston 22 which is then pushed downwards.

The spool 21 of the distributor 20 is carried by said first piston 22 to its lower end stop, at which the second chamber 7 of the pneumatic cylinder 3 is in communication with the atmosphere through the access hole 37 of the second duct 17, the interconnection cavity 50 of the spool 21 and the hole 19 for discharging into the atmosphere, while the first chamber 6 of the pneumatic cylinder 3 is pressurized through the connection chamber 15 and the access hole 36 to the duct 16.

In this condition, the piston 5 of the pneumatic cylinder 3, and consequently the pump shaft 8, continue to descend favouring the expulsion of viscous fluid from the outlet mouth 14 of the pump 1.

Figure 6:
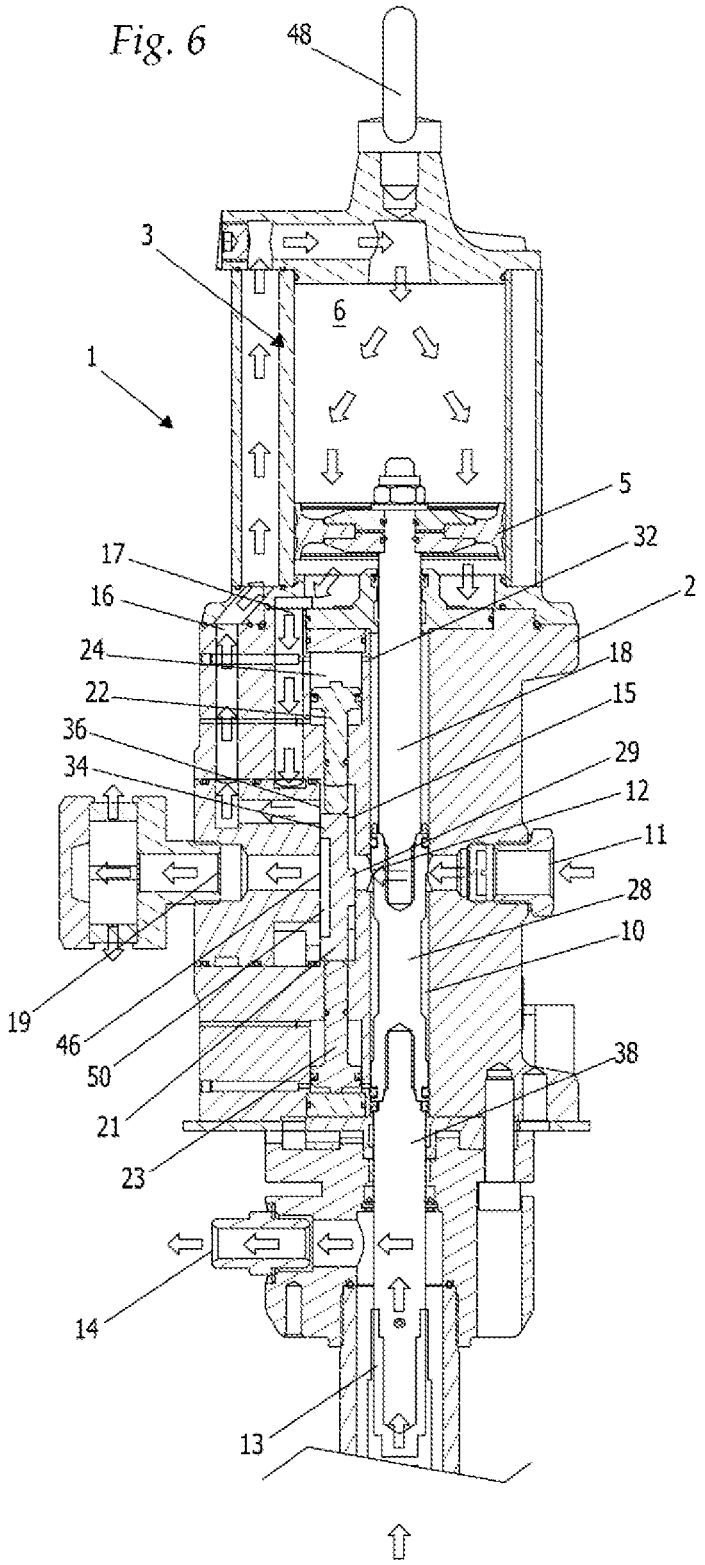
FIGS. 6 and 7 show a longitudinal section along a vertical plane of the pneumatic pump of FIG. 1 during operation, in two opposite working steps.

When the pump shaft 8 reaches the lower limit switch, the pressure chamber 10 is in communication with the service chamber 25 of the second pneumatic piston 23 through the port 33, realizing the working condition illustrated in FIG. 6.

At this point the second pneumatic piston 23 pushes the spool 21 of the distributor upwards inside the connection chamber 15, up to its upper end stop, at which the first chamber 6 of the pneumatic cylinder 3 is in communication with the atmosphere through the access hole 36 of the first duct 16, the interconnection cavity 50 of the spool 21 and the discharge hole 19 into the atmosphere, while the second chamber 7 of the pneumatic cylinder 3 is pressurized through the connection chamber 15 and the access hole 37 to the duct 17, causing the piston 5 and the pump shaft 8 to rise and therefore the pumping of viscous fluid from the dip tube 27, until it returns to the initial conditions and resumes the cycle described.

When the exchange is completed, the raised edge 34 of the spool 21 has completely opened the access hole of the duct to the chamber of the pneumatic cylinder which in the previous step was discharged into the atmosphere, allowing it to be filled and pushing the piston to the next end of stroke where the process will reverse again in a cyclical manner.

It should be emphasized that, during the transit of the distributor from one position to another, the thickening 29 of the spool 21 partializes the outlet 12 of the air from the pressure chamber 10 towards the connection chamber 15: it follows the creation of a return pressure wave due to the sudden reduction in supply which propagates along the pressure chamber 10, accelerating the alternating movement (depending on the position of the pump shaft) of the pneumatic pistons 22, 23 on the spool 21.

In this way the reversal of motion of the piston 5 of the pneumatic cylinder 3 becomes instantaneous, avoiding dangerous risks of pneumatic stalling and minimizing the reversal times and considerably increasing the flow rate, minimizing pressure fluctuations in the dip tube 27.

This return pressure wave therefore has two functions: the first is to avoid the fluid-dynamic stall of the pump and the second is to be able to halve the exchange time, allowing the pump to remain powered until the last stages of the piston stroke.

Mechanical locking systems of the spool are not necessary, as its design is designed to ensure perfect adhesion of the same to the distribution block by exploiting only the pressure of the supply air which, by pressing on the rear part of the spool itself, is able to efficiently support the low weight of the part even at the minimum operating pressures.

The invention claimed is:

1. An industrial pneumatic pump for a viscous fluid comprising:

a pump body;

a double-acting pneumatic cylinder comprising an external liner, a piston, a first chamber and a second chamber separated by said piston;

a pump shaft integral with said piston and sliding in a channel;

a pressure chamber arranged along said channel and provided with an inlet port for compressed air and an outlet port for said air;

a suction mouth for said viscous fluid;

an outlet mouth for said viscous fluid;

a connection chamber connected to said first and second chambers by means of a first and a second duct and corresponding access holes, respectively, and to said channel in which said pump shaft slides by means of said outlet port, and provided with a hole for discharging air into the atmosphere;

a distributor comprising a spool adapted to put said first chamber and said second chamber in communication respectively and alternatively with an air discharge hole to the atmosphere and with said an outlet port of said air, implementing a reversal system for said double-acting pneumatic cylinder;

a first and a second pneumatic pistons acting opposite each other on said spool to move said spool in said connection chamber, sliding respectively in a first and a second service chamber connected to said channel in which said pump shaft slides by means of ports;

a base for fixing said pump body to a dip tube in which said suction mouth is formed, wherein said spool sliding in said connection chamber due to the effect of said pneumatic pistons opens or closes the access holes of said first and second duct alternatively, putting the respective chambers of said pneumatic cylinder under pressure or discharging the respective chambers, wherein said spool comprises a thickening adapted to cooperate with said air outlet port from said pressure chamber to modulate the entry of air into said connection chamber and cause a pressure perturbation in the service chambers of said first and second pneumatic piston, causing the immediate displacement of the piston called to act on the spool.

2. The industrial pneumatic pump according to claim 1, wherein said spool has an elliptical disc shape and comprises a first face facing said air outlet port from said pressure chamber and a second face facing said hole for discharge into the atmosphere.

3. The industrial pneumatic pump according to claim 2, wherein said thickening is obtained in a central portion of said first face of said spool.

4. The industrial pneumatic pump according to claim 2, wherein said second face of said spool comprises a raised edge, where said raised edge cooperates alternatively with access holes to said first and second ducts.

5. The industrial pneumatic pump according to claim 1, wherein said pump shaft comprises a first, a second and a third elongated element, each having a first and a second end, where:

the first end of said first elongated element is stably associated with said piston;

the second end of said first elongated element is stably associated with the first end of said second elongated element with the interposition of a first ring gasket;

the second end of said second elongated element is stably associated with the first end of said third elongated element with the interposition of a second ring gasket;

the second end of said third elongated element is associated with said dip tube by means of a non-return valve.

6. The industrial pneumatic pump according to claim 5, wherein said first and said second ring gasket delimit said pressure chamber inside said channel.

7. The industrial pneumatic pump according to claim 5, wherein said first and second ring gaskets are supported along said pump shaft by centring bushings comprising a mixture of acetal resin and glass fibre.

8. The industrial pneumatic pump according to claim 5, wherein said third elongated element of said pump shaft is selected from a plurality of elements with different diameters according to the type and flow rates of the viscous fluid pumped and the type of dip tube.

9. The industrial pneumatic pump according to claim 1, wherein said base comprises a hollow cylindrical body reversibly fixed to said pump body by means of screws.

10. The industrial pneumatic pump according to claim 1, wherein said base comprises a radial outlet sight hole to convey outwards any oil leaks from said dip tube and thus signal leaks.

11. The industrial pneumatic pump according to claim 1, wherein said first and second connection duct between said connection chamber and said first and second chambers separated by said piston are entirely contained within said pump body.

* * * * *